US010124353B1

(12) United States Patent
Bottiger et al.

(10) Patent No.: US 10,124,353 B1
(45) Date of Patent: Nov. 13, 2018

(54) APPARATUS FOR DEAGGLOMERATING AND DISSEMINATING POWDERS AND PARTICULATE MATTER

(71) Applicant: U.S. Army Edgewood Chemical Biological Center, APG, MD (US)

(72) Inventors: Jerold R Bottiger, Aberdeen, MD (US); Tiffany A. Sutton, Fallston, MD (US); Daniel R VanReenen, Aberdeen, MD (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 188 days.

(21) Appl. No.: 15/407,995

(22) Filed: Jan. 17, 2017

(51) Int. Cl.
*B05B 7/14* (2006.01)
*B05B 9/04* (2006.01)

(52) U.S. Cl.
CPC ..... *B05B 7/144* (2013.01); *B05B 7/1459* (2013.01); *B05B 9/04* (2013.01)

(58) Field of Classification Search
CPC ..... B05B 7/144; B05B 7/1459; B05B 7/1472; B05B 9/04; B05B 7/00–7/32; B05B 9/00–9/0894
USPC ..... 73/864.81–864.87; 239/304, 318, 543, 239/545, 144
See application file for complete search history.

(56) References Cited

U.S. PATENT DOCUMENTS 5,884,846 A * 3/1999 Tan ..... B05B 7/0475 128/200.21
2002/0092468 A1* 7/2002 Mauchle ..... B05B 7/1404 118/309

* cited by examiner

*Primary Examiner* — Darren W Gorman
*Assistant Examiner* — Juan C Barrera
(74) *Attorney, Agent, or Firm* — Ulysses John Biffoni

(57) ABSTRACT

An apparatus for deagglomerating and aerosolizing particulate matter such as powders, the apparatus including a rotatable turntable having a plurality of circumferentially spaced wells adapted to contain a powder. A pair of conduits are fluidly connected to the turntable wells so that powder from the wells is inducted and drawn to two nozzles so that the powder is entrained in the gas flow exiting each nozzle. Furthermore, the nozzle outlets are aligned and spaced apart from each other, but positioned to direct their particle entrained gas flow in the opposite and facing direction to one another so that the flow from each nozzle impinges upon the flow from the other nozzle to further air mill and deagglomerate the individual powder particles.

8 Claims, 3 Drawing Sheets

APPARATUS FOR DEAGGLOMERATING AND DISSEMINATING POWDERS AND PARTICULATE MATTER

GOVERNMENT INTEREST

The invention described herein may be manufactured, used, and licensed by or for the United States Government.

BACKGROUND OF THE INVENTION

I. Field of the Invention

The present invention relates generally to a device for deagglomerating and disseminating powders and particulate matter in order to produce aerosols.

II. Description of Related Art

There are many different types of lab experiments in which powders and aerosols form a part of a test experiment. In these types of tests, it is oftentimes desirable to disseminate or aerosolize small quantities of powdered materials at a steady concentration and which can be varied by the operator. It is also desirable to produce maximal breakup or deagglomeration of the powder material into its smallest natural sized particles when the aerosol is produced and tests are conducted.

Unfortunately, many if not most types of powders tend to agglomerate into masses that, while small, are still many times larger than the individual powder particles. Consequently, in those situations it is necessary to break up the masses of powder particles thereby reducing the overall size of the powder particles to their native sizes. In addition, it is difficult to produce a steady concentration of aerosol particles using low volume powders over time.

While there have been previously known methods for breaking up agglomerated particle matter, these previously known methods are not only time consuming, but also often fail to completely separate the powder into its separate individual powder particles. This, in turn, may adversely affect the results of testing utilizing the powder that is not entirely separated into its separate particles.

SUMMARY OF THE PRESENT INVENTION

The present invention provides an apparatus for deagglomerating and disseminating powders and particulate matter and producing a steady concentration of aerosolized particles over time using low volumes of powders, which overcomes the above-mentioned disadvantages of the previously known devices.

In brief, the present invention comprises a base having a turntable rotatably mounted to the base. This turntable in turn includes a plurality of circumferentially spaced wells relative to the axis of rotation of the turntable which may be filled with the powder to be processed. The turntable itself is rotatably driven by a motor and, preferably, the speed of rotation of the turntable may be varied as desired by the operator.

The wells on the turntable are then filled with the powder to be deagglomerated and disseminated. An elongated first conduit has one open end disposed to the turntable and aligned with the wells. Air flow drawn through the conduit then inducts powder contained in the wells into the air flow through the conduit. The other end of the conduit is mounted to a nozzle disposed within a powder aerosol collection housing.

The nozzle comprises a tubular and cylindrical housing having a tube disposed therein which is connected at one end to the conduit. The nozzle housing is larger in diameter than the tube and is disposed around the tube thus forming a cylindrical chamber around the tube. This cylindrical chamber, however, is open at one end forming an outlet for the nozzle which surrounds and is spaced outwardly from an open end of the tube. Consequently, upon connection of a pressurized gas source to the nozzle's cylindrical chamber, the gas flow through the nozzle outlet opening draws or inducts powder contained in the turntable wells through the conduit into the tube and out through the nozzle's outlet.

A second substantially identical nozzle is mounted to the particle collection housing so that it is also similarly fluidly connected to the wells in the turntable using a second conduit. However, the second nozzle is fluidly connected to wells different from those in fluid connection with the first nozzle. Furthermore, the nozzles are arranged so that the output from each nozzle is coaxial and spaced apart from the opening in the other nozzle and facing one another.

Thus, the nozzles are arranged in the collection housing so that they produce their particle entrained fluid flow in directions opposite one another. Consequently, the gas flow with the entrained particles from one nozzle impacts upon the gas flow with the entrained particles from the other nozzle. The force of the impact not only breaks the powder components into finer particles through an air milling effect, but the velocity moments of the two high speed gas streams cancel each other. Consequently, the now deagglomerated particles may be conducted away from the collection housing at a much lower velocity to the target test system for testing or other uses.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
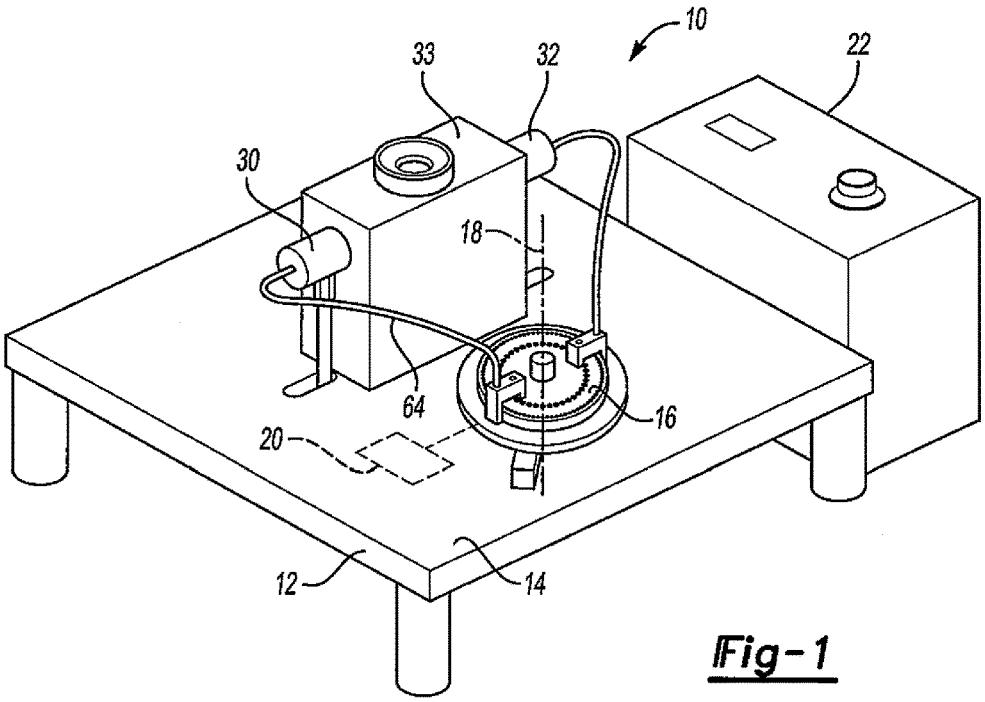
FIG. 1 is an elevational view illustrating a preferred embodiment of the present invention.

With reference now to FIG. 1, an apparatus 10 for disseminating and deagglomerating particulate matter is shown. The apparatus 10 includes a base 12 having an upper horizontal surface 14. The base 12 may be constructed of any suitable rigid material.

Figure 2:
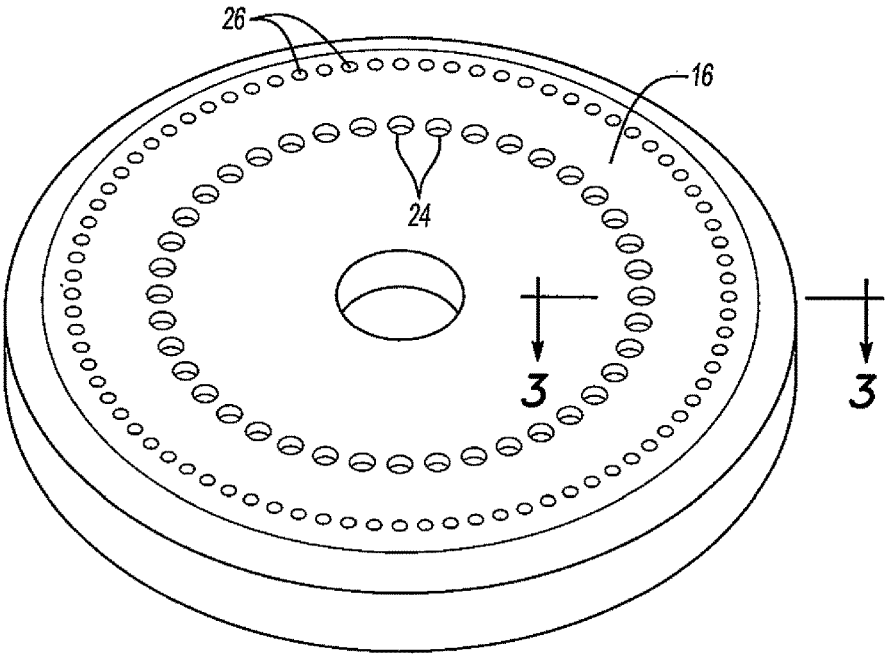
FIG. 2 is an elevational view of a turntable.

With reference now to FIGS. 1 and 2, a particle turntable 16 is rotatably mounted to the base 12 about a vertical axis 18. Any conventional motor, such as a variable speed electric motor 20 (illustrated only diagrammatically), may be used to rotatably drive the turntable 16 about its axis 18. A conventional speed controller 22 is operatively connected to the motor 20 to control the speed of the motor 20 and thus the speed of rotation of the turntable 16 from about 1 minute per revolution to 18 minutes per revolution.

Figure 3:
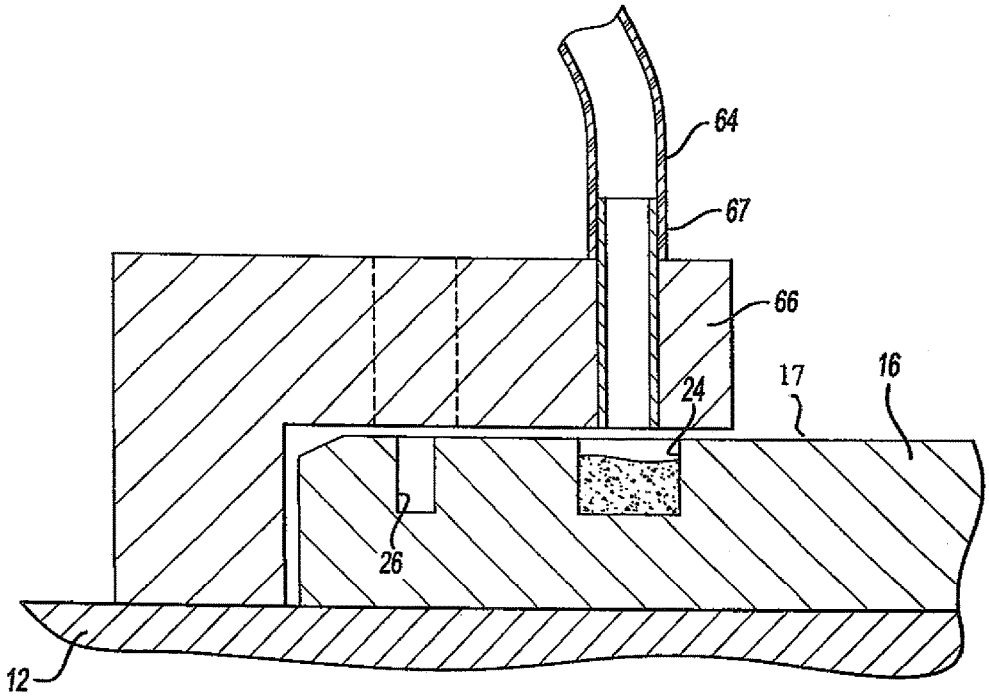
FIG. 3 is a sectional view illustrating a portion of the preferred embodiment at the turntable of the present invention.

As shown in FIGS. 2 and 3, the turntable 16 includes at least one and preferably two rows of wells 24 and 26 on its upper surface. Each well 24 and 26 is open at its top.

The actual dimensions for the wells 24 and 26 are not critical. However, as shown, the turntable 16 is approximately 4 inches in diameter and the inner row of wells 24 are formed at a radius of approximately 1 inch from the center and are 0.161 inch in diameter and 0.175 inch deep. This produces a volume of about 65 cubic millimeters of powder.

The second row 26 of wells are formed at a radius of 1.5 inches on the turntable 16 and have a smaller diameter of 0.082 inch and a depth of 0.15 inch. This produces a volume of about 13 cubic millimeters of powder and these wells deliver the smallest amounts of powders to produce smaller particle concentrations.

Figure 4:
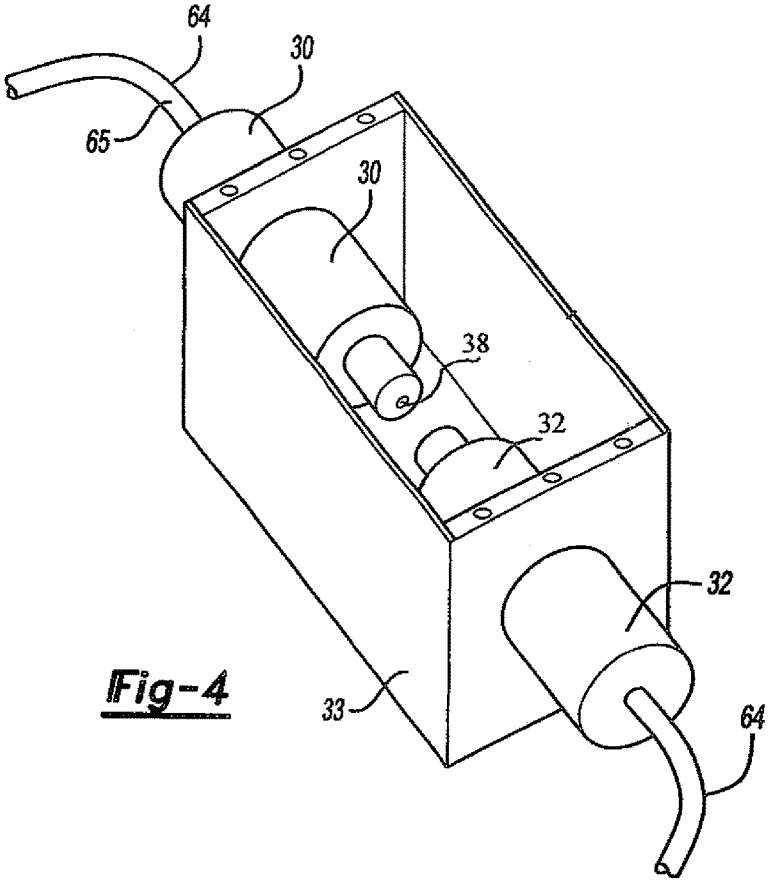
FIG. 4 is an elevational view of the particle collection housing with parts removed for clarity.

With reference now to FIGS. 1 and 4, two nozzles 30 and 32 are mounted to a particle collection housing 33 on the base 12 so that the nozzles 30 and 32 are coaxial and aligned with each other so that their outlets 38 are directed toward each other. Furthermore, since the nozzles 30 and 32 are substantially identical to each other, only one nozzle 30 will be described in detail, it being understood that a like description shall also apply to the nozzle 32 and its associated components.

Figure 5:
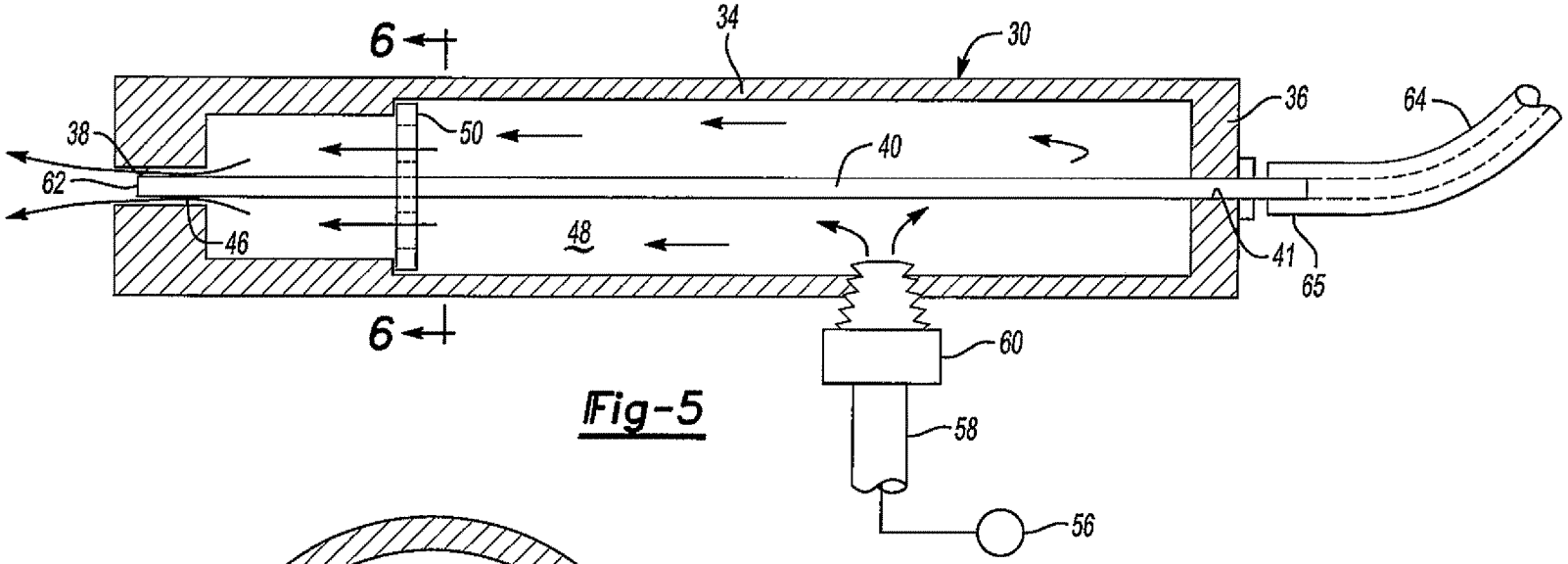
FIG. 5 is a sectional view of a nozzle of the invention.

With reference then to FIG. 5, the nozzle 30 is there shown in greater detail and includes an outer tubular and cylindrical housing 34 closed at one end 36 but having an opening 38 at its opposite end. An elongated tube 40 extends through a bore 41 at closed end 36 of the housing and coaxially through the housing 34 so that a chamber 48 is formed between the housing 34 and the tube 40. An open end 62 of the tube 40 is positioned within the opening 38 in the housing 34. Furthermore, the outer diameter of the tube 40 is less than the diameter of the opening 38 so that an annular space 46 is formed around the tube 40 at its open end 62. The space 46 thus allows fluid to flow from the chamber 48 out through the opening 38 and around the end of the tube 40.

Figure 6:
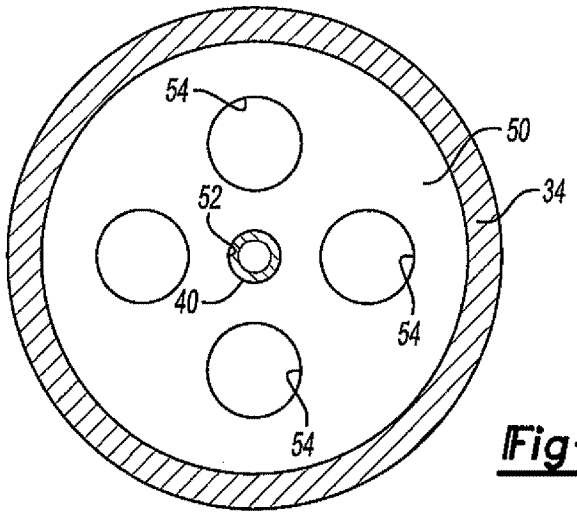
FIG. 6 is a view taken along arrows 6-6 in FIG. 5 with parts removed and enlarged for clarity.

As shown in FIGS. 5 and 6, a spacer 50 is also contained within the chamber 48. This spacer 50 includes a central throughbore 52 through which the tube 40 extends. This throughbore 52 is dimensioned to align the end 62 of the tube 40 in substantially the center of the housing opening 38. The spacer 50 also contains a plurality of throughbores 54 to allow free fluid flow from the chamber 48 through the spacer 50.

As shown in FIG. 4, the nozzles 30 and 32 are mounted to the collection housing 33 so that the nozzles 30 and 32 are aligned and spaced apart from each other. Furthermore, as shown in FIGS. 1, 3 and 5, one end of the tube 40 (FIG. 5) is fluidly connected to one end 65 of the conduit 64. The other end 67 (FIG. 3) of the conduit 64 is fluidly connected to a tube support 66 mounted on the base 12 and which over lies the turntable 16 above the wells 24 or 26.

As shown in FIG. 5, a source 56 of gas pressure, such as air pressure, is fluidly connected by a conduit 58 and connector 60 to the nozzle housing chamber 48. Consequently, when gas pressure from the source 56 is applied to the chamber 48, the gas exhausts out through the open end 38 of the nozzle housing 34. This gas flow, in turn, creates a suction at the open end 62 of the tube 40, which draws the powder in the wells 24 or 26 through conduit 64 into nozzle tube 40 and out through open end 62 of the tube 40 and nozzle opening 38.

With reference now to FIGS. 3 and 5, the suction created at the open end 62 of the tube 40 by the gas flow from the high pressure source 56 is fluidly communicated to the other end of the conduit 64 which is attached to the table 12 by a tube support 66. This tube support 66, furthermore, is spaced upwardly from an upper surface 17 of the turntable 16. Consequently, as gas is inducted from the open end 62 of the tube 40, gas is drawn and inducted through the conduit 64 and through the space between the tube support 66 and the top of the turntable 16. Consequently, when the conduit 64 is aligned with a well 24 or 26 in the turntable 16, any powder contained within that well 24 or 26 is inducted up through the conduit 64 and entrained in the high speed gas flow ejected from the open end 62 of the tube 40.

With reference now to FIG. 4, the gas flow with the entrained particles from the ends 38 of the nozzles 30 and 32 impact each other between the nozzles 30 and 32. Since the fluid velocity is substantially the same from both nozzles 30 and 32, the net impact from the two nozzles results in a gas flow of very low speed. Furthermore, the impact of the two particle-laden streams from both of the nozzles 30 and 32 effectively further separates any agglomerated particles apart from each other and into smaller particle sizes until the smallest natural particle sizes are reached through an air milling process. The rotation of turntable 16 and wells 24 and 26 and the gas flow rate through the nozzles serves to generate a continuous flow of powder particles at set concentrations.

From the foregoing, it can be seen that the present invention provides a simple, yet effective mechanism for deagglomerating and disseminating particulate matter. Having described our invention, however, many modifications thereto will become apparent to those of ordinary skill in the art to which it pertains without deviation from the spirit of the invention as defined by the scope of the appended claims.

We claim:

1. An apparatus for deagglomerating and disseminating particulate matter, comprising:

a turntable having a plurality of circumferentially spaced wells formed therein for holding particulate matter, and a motor drivingly connected to said turntable to rotatably drive said turntable;

a first fluid nozzle and a second fluid nozzle, wherein each nozzle comprises a nozzle housing disposed around a tube and forming a fluid chamber therebetween, said nozzle housing having an opening surrounding an open end of said tube to form a nozzle outlet, and wherein said nozzles are disposed within a particle collection housing so that a fluid flow from the outlets of said nozzles impinge on each other;

a pair of fluid conduits, a first fluid conduit having one end fluidly open to said turntable wells holding particulate matter and the other end being attached to said tube in said first nozzle, and a second fluid conduit having one end fluidly open to said turntable wells holding particulate matter and the other end being attached to said tube in said second nozzle, so that the turntable wells are fluidly connected to said nozzles; and a source of pressurized gas fluidly connected to said nozzles so that gas flows from said pressurized gas source into said fluid chamber and out through the nozzle outlet so that the gas flow inducts particulate matter from said turntable wells through the fluid conduits and tubes and out the nozzle outlets.

2. The apparatus as defined in claim 1, wherein said plurality of circumferentially spaced wells comprises two rows of circumferentially spaced wells, said rows of wells spaced apart and formed at a radius different from one another on said turntable.

3. The apparatus as defined in claim 2, wherein the wells in each row of circumferentially spaced wells are the same volume, but are a different volume from the wells in the other row.

4. The apparatus as defined in claim 1, wherein said motor comprises a variable speed motor.

5. The apparatus as defined in claim 1, wherein said turntable and said particle collection housing are mounted on a base.

6. The apparatus as defined in claim 5, further comprising a first support mounted to said base and above said turntable, said one end of said first fluid conduit being attached to said support and aligned with and spaced above said turntable so that gas flowing through said first fluid conduit draws and inducts any particulate matter contained in said wells into said gas flow.

7. The apparatus as defined in claim 6, further comprising a second support attached to said base at a position diametrically opposed from said first support, said one end of said second fluid conduit being attached to said second support and aligned with and spaced above said turntable so that gas flowing through said second fluid conduit draws and inducts any particulate matter contained in said wells into said gas flow.

8. The apparatus as defined in claim 1, further comprising a spacer disposed in said fluid chamber, said spacer having a throughbore through which the tube extends and is aligned with a center of the nozzle housing opening, and a plurality of additional throughbores to allow free gas flow from the chamber to the nozzle outlet.

* * * * *